US005492584A

United States Patent [19]

Bateman

[11] Patent Number: 5,492,584

[45] Date of Patent: Feb. 20, 1996

[54] METHOD FOR MAKING A PLEATED ORNAMENT

[75] Inventor: Sandra Bateman, Port St. Lucie, Fla.

[73] Assignee: Papillon Creations, Inc., Lake Worth, Fla.

[21] Appl. No.: 239,319

[22] Filed: May 6, 1994

[51] Int. Cl.[6] ..... A63H 33/16

[52] U.S. Cl. ..... 156/207; 156/61; 156/63; 156/197; 156/227; 428/4; 428/16; 493/955; 493/959

[58] Field of Search ..... 156/61, 63, 197, 156/474, 207, 227; 493/955, 959; 428/16, 9, 12, 4

[56] References Cited

U.S. PATENT DOCUMENTS

| | | | |
|---|---|---|---|
| D. 234,467 | 3/1975 | Del Grosso | 428/16 |
| 303,087 | 8/1884 | Wezel | 428/16 |
| 563,489 | 7/1896 | Johnson | 428/16 X |
| 2,141,235 | 12/1938 | Angeletti | 493/955 X |
| 4,319,941 | 3/1982 | Brownell | 156/61 |
| 5,015,317 | 5/1991 | Corey et al. | 156/474 X |
| 5,334,275 | 8/1994 | Romeo et al. | 156/197 X |

*Primary Examiner*—Jeff H. Aftergut
*Attorney, Agent, or Firm*—Quarles & Brady

[57] ABSTRACT

A decoration is formed by feeding a flat sheet of material between a pair of rotating rollers having intermeshed teeth which produce a series of pleats in the sheet. The pleats are gathered together by placing the pleated sheet between a pair of parallel, spaced apart plates and then moving a compressor plate between the spaced apart plates to compact the pleats. A tie can be fastened around the compacted, pleated sheet to hold the pleats in a gathered state. The tied sheet is removed from between the plates and ends of the gathered pleats are fanned out on at least on side of the tie. Apparatus for pleating the sheet and compressing the pleats is disclosed.

6 Claims, 4 Drawing Sheets

METHOD FOR MAKING A PLEATED ORNAMENT

BACKGROUND OF THE INVENTION

The present invention relates to ornaments and decorations formed from pleated material; and more particularly to methods and apparatus for manufacturing such ornaments and decorations.

Decorative objects for adorning the outside of gift wrapped packages have been created from sheet material that has been repeatedly folded in a pleated pattern. For example, a butterfly 10 shown in FIG. 1 is formed by upper and lower pleated segments 11 and 12. The two pleated segments then are held in a compacted manner against each another along seam 14. A tie 16 is placed around the middle to hold the bundled segments 11 and 12 together. Next the outer edges 18 and 19 of segments 11 and 12, respectively, were fanned out to form the butterfly shape, while the midpoint is held compressed by the tie 16. The center tied area is covered by a piece of felt 17 cut in the shape a butterfly thorax. An adhesive patch (not shown) can be attached to the underside of the decorative object for fastening to a gift package, or other surface.

Previously, the sheet material which formed segments 11 and 12 of the butterfly 10 was folded into pleats by hand and then manually compressed and held together while tie 16 was applied. The hand folding operation was tedious and did not always produce uniformly pleated material which was obvious in the finished object. With complex decorations, a single assembly person found it difficult to compact several segments 11 and 12 and hold them together while applying the tie. Unless the two segments 11 and 12 were firmly compacted during the tying process, the segments were not always securely fastened together, which also adversely affected the appearance of the finished ornament.

SUMMARY OF THE INVENTION

An object of the present invention is to provide a method and apparatus which allows one person to manufacture a pleated ornament, and especially a multiple segment ornament.

Another object of the present invention is to provide an apparatus that enables one assembly person to rapidly fabricate the pleated ornament.

A further object of the present invention is to provide a method and apparatus for manufacturing a plurality of decorative ornaments with a high degree of uniformity.

Yet another object of the present invention is to provide a method and manufacturing apparatus which can be utilized to produce a wide variety of different pleated ornaments.

An ornament is made by a method in which the first step is producing a blank of the ornament from a sheet of material. That flat blank then is fed between a pair of rotating rollers having intermeshed teeth which produce a series of pleats in the blank.

The pleated blank is placed between a pair of parallel plates which are spaced apart by a distance approximately equal to the width of the pleats. Then a compressor plate is slid between the pair of parallel plates to gather together the pleats of the blank. For example, the compressor plate compacts the pleated blank against a stop that is located between the parallel plates near one edge.

The parallel plates have openings that enable a tie to be placed around the compacted blank and then secured to hold the pleats in a gathered state. An operator removes the tied blank from between the plates and fans out the pleats on at least on side of the tie to form the shape of the finished ornament.

DETAILED DESCRIPTION OF THE INVENTION

The present invention will be described in the context of producing a decorative butterfly 10 shown in FIG. 1. However, it will be understood by those skilled in the art that numerous other types of pleated decorative objects can be fabricated using the present method and apparatus.

Figure 2:
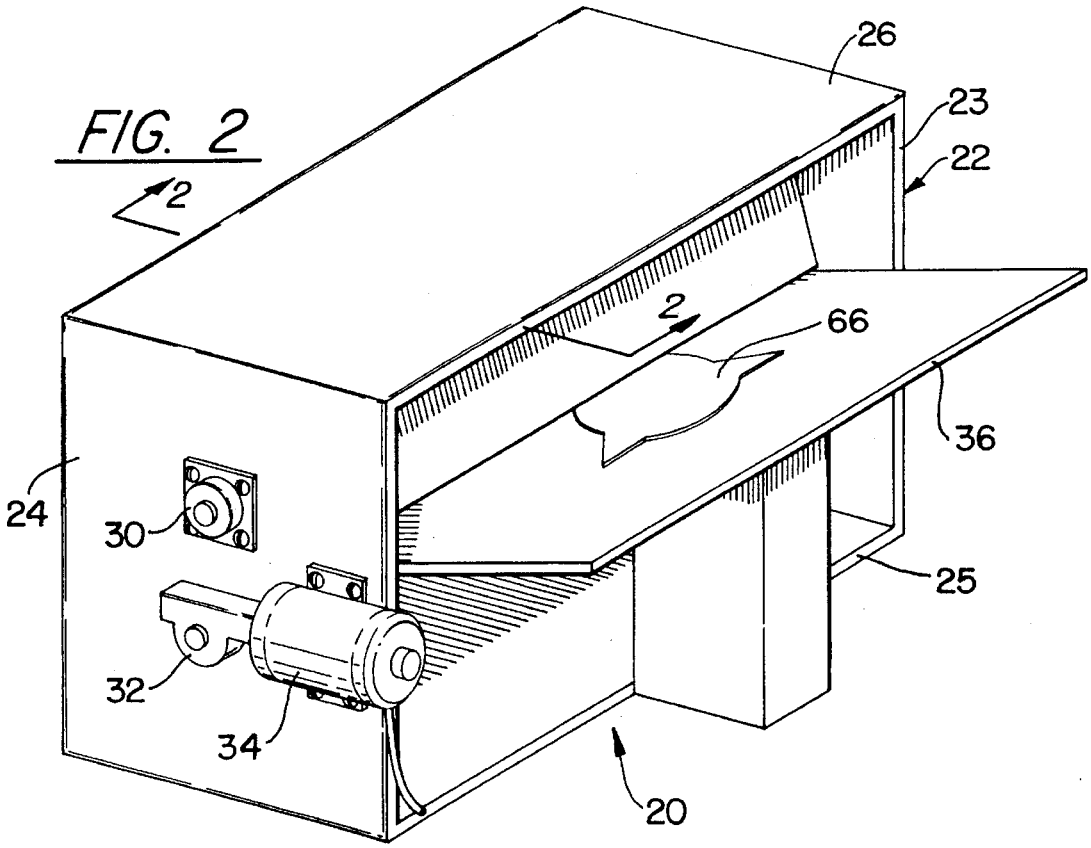
FIG. 2 is an isometric view of a machine for creasing a blank of the ornament.
Figure 3:
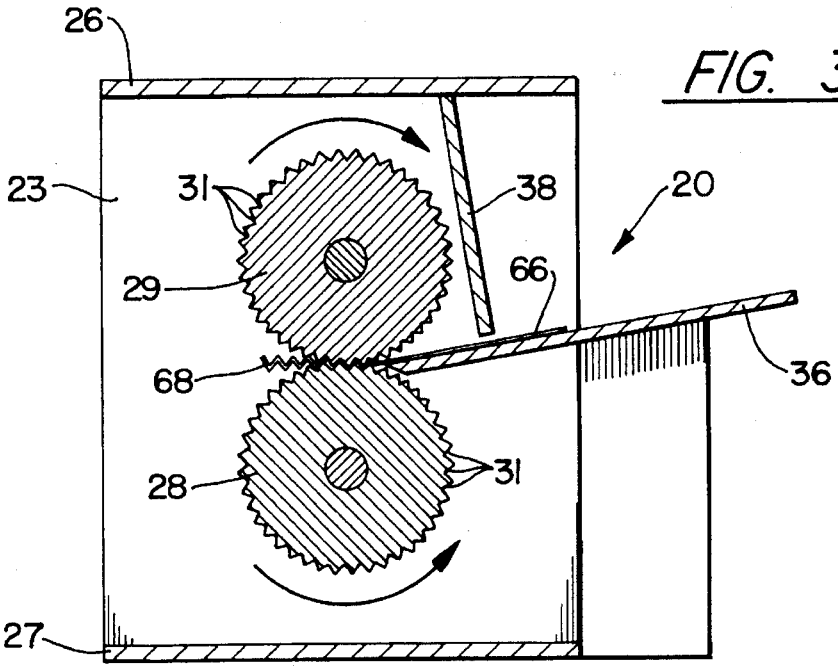
FIG. 3 is a cross sectional view taken along line 2—2 of FIG. 2.

With reference to FIGS. 2 and 3, a creasing machine 20 is utilized to produce periodic creases in a sheet of material, such as decorative paper or foil paper used in gift wrapping, and create a pleated pattern. The creasing machine comprises an rectangular frame 22 with a pair of vertical walls 23 and 24 spaced apart by bottom and top walls 25 and 26, respectively, and with open left and right sides as oriented in the drawings. A pair of rollers 28 and 29 extend between vertical walls 23 and 24 within frame 22 and have shafts at each end that are mounted to bearings 30 on the vertical walls enabling the rollers to rotate about their longitudinal axes. A shaft at one end of the lower roller 28 extends through an aperture in wall 24 and is connected to a transmission 32. An electric motor 34 drives the transmission 34 thereby producing rotation of rollers 28 and 29 in directions indicated by a curved arrow associated with each roller in FIG. 3.

The rollers 28 and 29 have gear teeth 31 cut longitudinally along their curved surfaces. As the rollers rotate within frame 22, the teeth of lower roller 28 mesh with the teeth of upper roller 29. The spacing between the rollers 28 and 29 allows a sheet 66 of material to pass in-between the rotating rollers to create pleats in the sheet.

A guide tray 36 is mounted at an angle between the two vertical walls 23 and 24 of the frame 22 with an inner edge of the guide tray aligned with the region at which the two rollers 28 and 29 mesh. A shield 38 extends within the frame 22 substantially perpendicular to the guide tray 36 with a small gap there between which allows a sheet 66 of material to pass into the rollers 28 and 29. The shield 38 prevents the operator's fingers from accidentally contacting the upper roller 29 while feeding the sheet 66 into the creasing machine 20.

Figure 4:
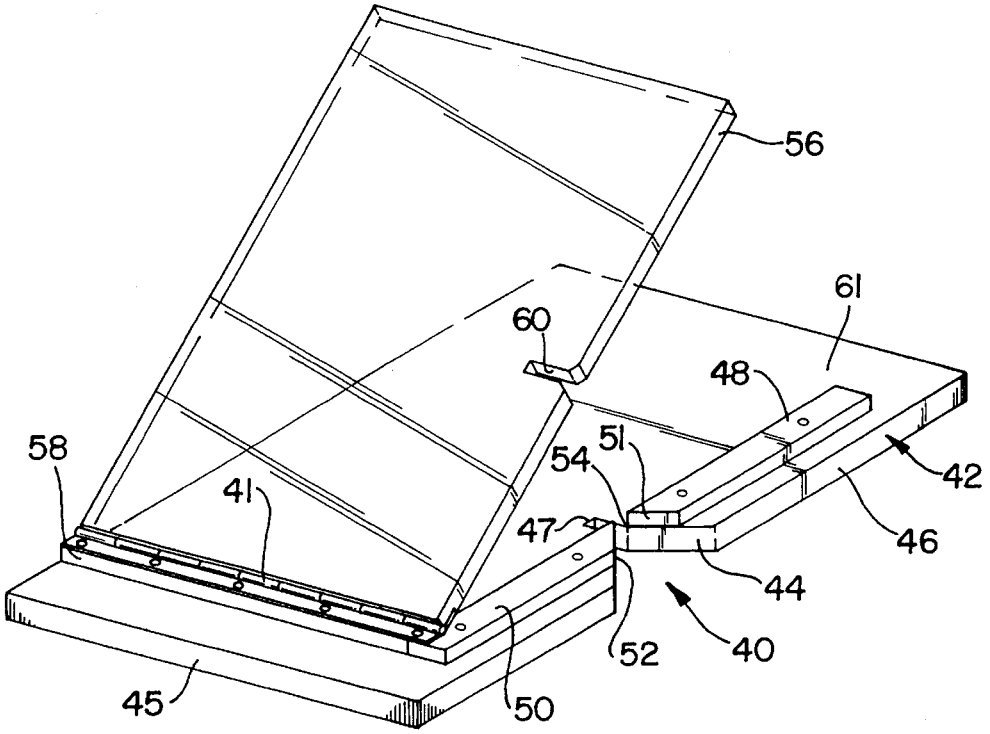
FIG. 4 is an isometric view of a pleat compressor used in the manufacture of the ornament.
Figure 5:
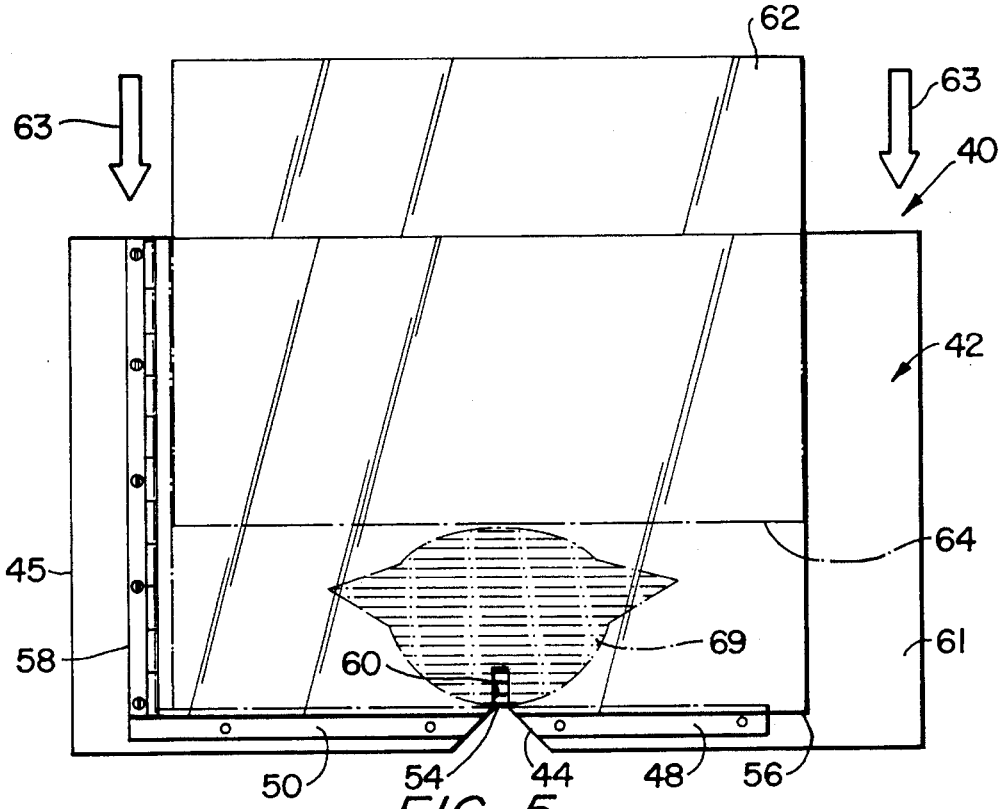
FIG. 5 is a top view of the pleat compressor in one stage of operation.

With reference to FIGS. 4 and 5, a pleat compressor 40 is utilized to gather together the pleats of a creased sheet of material into a compacted form. The pleat compressor 40 has a flat metal base plate 42 with a horizontal V-shaped groove 44 cut in one longitudinal edge 46 and a narrow rectangular notch 47 extends farther into the base plate from the apex of the groove. A pair of aligned stop members 48 and 50 are attached to the top surface 61 adjacent the longitudinal edge 46 of the base plate 42. Each of the stop members 48 and 50 has a tapered end 51 and 52, respectively, which conforms to the angle of the V-shaped groove 44 and is aligned with a edge of that groove. The two stop members are spaced apart from one another to form a gap 54 at the apex of the V-shape groove 44 in the base plate 42 which gap 54 exposes the notch 47 in the base plate.

A transparent plastic cover plate 56 is coupled by a hinge 58 to the top surface 61 of base plate 42. Specifically the hinge is connected to the cover plate along short side 41 that is adjacent and parallel to one short side 45 of the base plate. The hinge 58 spaces the cover plate 56 above the top surface 61 of the base plate by the thickness of the two stop members 48 and 50. The stop member thickness also defines spacing between the two plates when the cover plate 56 is in a closed position parallel to the base plate 42. The spacing between plates 42 and 56 corresponds to the width of each crease of the sheet material produced by the creasing machine 20. The cover plate 56 extends over the two stop members 48 and 50 and rests against those plates in the closed position. A rectangular notch 60 is cut in an edge of the cover plate 56 and aligned with the apex of the V-shaped groove 44 in the base plate 42 when plates 42 and 56 are closed parallel to each other as shown in FIG. 5.

Figure 6:
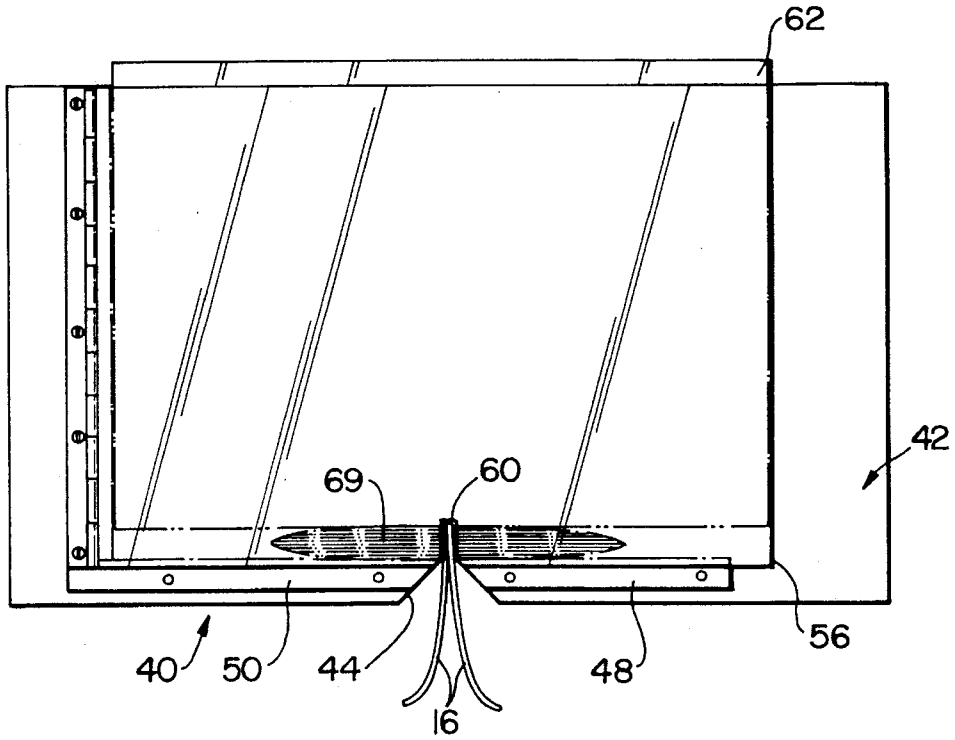
FIG. 6 is a top view of the pleat compressor in a subsequent stage of operation.

The pleat compressor 40 also includes a compressor plate 62 which is slightly larger than the cover plate 56 and has a thickness equal to the spacing between the cover plate 56 and the base plate 42 when pleat compressor is closed. Thus when the pleat compressor 40 is closed, the compressor plate 62 is able to slide between the cover plate 56 and the base plate 42 as illustrated in FIGS. 5 and 6.

Figure 1:
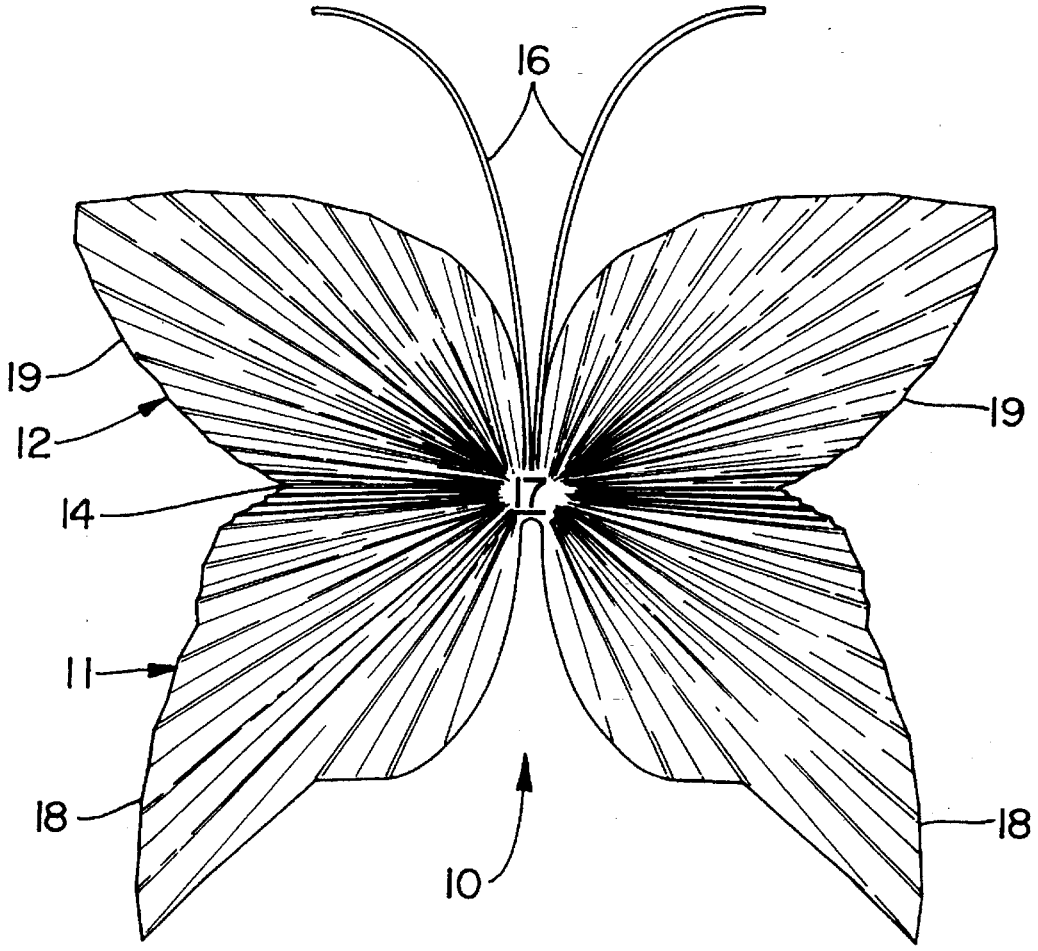
FIG. 1 Is a plane view of an exemplary pleated ornament in the form of a butterfly.
Figure 7:
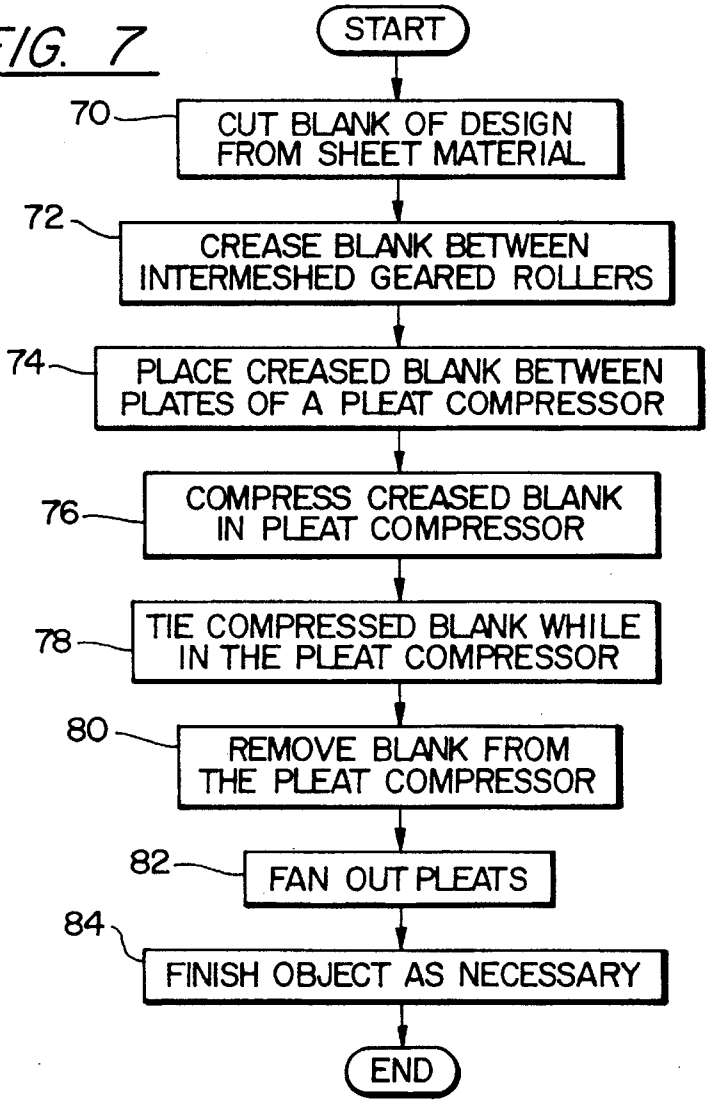
FIG. 7 is a flowchart of the manufacturing process used to produce a pleated ornament.

FIG. 7 illustrates a flowchart of a process which uses the sheet creasing machine 20 and the pleat compressor 40 to manufacture a ornament, such as butterfly 10 in FIG. 1. Initially at step 70, a blank 66 for the ornament is cut from sheet material, such as heavy gift wrapping paper or foil, for example. In the case of the butterfly 10, separate blanks are cut out for each of the segments 11 or 12. The flat blank 66 then at step 72 is fed through the creasing machine 20 as shown in FIG. 3. In doing so, an operator places the blank 66 on the guide tray 36 and pushes the blank into the machine to engage the rotating rollers 28 and 29. The flat blank 66 is drawn between the rollers which creases the material forming a series of pleats 68 as the sheet exits the rollers as a creased blank 69.

Next at step 74, the operator places the creased blank 69 onto the top surface 61 of pleat compressor 40 with the pleats running parallel to the stop members 48 and 50, as shown in FIG. 5. The creased blank 69 is oriented with respect to the gap 54 between the two stop members 48 and 50 so that the point in the blank at which the tie will be attached is aligned with that gap. For the butterfly 10, the pleated blank 69 is centered at the gap 54. The cover 56 of the pleat compressor 40 is closed over the pleated blank 69 until it contacts the stop members 48 and 50, thus reaching the closed position.

The operator then at step 76 slides the compressor plate 62 in-between the base plate 42 and cover plate 56 toward the stop members 48 and 50 in the direction indicated by arrow 63. When the inner edge 64 of the compressor plate 62 contacts the pleated blank 69, further movement of the compressor plate causes a gathering of the pleats and a compression of the blank against the stop members 48 and 50. The compressor plate 62 is pushed into the compressor 40 until the pleated blank 69 is fully compacted against the stop members 48 and 50. In the case where the decorative object is formed by two pleated segments, such as the butterfly 10, both segments may be compressed separately and then placed together in the pleat compressor 40 for tying together.

The tie 16, such as colored wire or a pipe cleaner, is passed through notch 60 in the cover plate 56 and notch 47 in the base plate 42 on one side of the compacted blank 69, at step 78. The ends of the tie then are bent around the compressed blank 69 into the V-shaped groove 44 and twisted to tightly hold the middle portion of the blank together. In the case of the butterfly 10, the ends of the tie 16 form the antenna of the finished ornament. In other types of decorative objects made in this manner, the exposed ends of the tie 16 can be cut off upon removal of the ornament from the compressor 40.

The blank 69 is removed from the pleat compressor 40 at step 80 and the operator manually fans out the portions of the blank on each side of the tie 16 at step 82. In the case of the butterfly 10, the fanning out of these portions of the blank form wings. Once the pleats have been fanned out, additional finishing steps may be performed at step 84. For example, these steps include applying a felt cut-out 17 which forms the thorax of the butterfly 10 and attaching an adhesive pad so that the decoration can be fastened to a package or other surface. For other decorations a ribbon can be placed around the tie.

I claim:

1. A method of making an ornament, steps of which method comprise:

producing a blank of the ornament from a sheet of material;

feeding the blank between a pair of rollers which are rotating and which have intermeshed teeth that produce a series of pleats in the blank;

placing the pleated blank between a pair of plates which are parallel and spaced apart;

moving a compressor plate between the pair of plates to gather together the pleats of the blank;

inserting a tie through at least one aperture in the plates;

placing the tie around the blank while the blank is between the plates to hold the pleats in a gathered state;

removing the blank from the plates with the pleats gathered and tied; and fanning out the pleats on at least one side of the tie.

2. The method as recited in claim 1, further comprising attaching decorative elements to the ornament after fanning out the pleats.

3. The method as recited in claim 1, further comprising attaching adhesive material to a surface of the ornament for fastening the ornament to a surface to be decorated.

4. The method as recited in claim 1, wherein the step of moving the compressor plate compacts the pleats of the blank against a stop member.

5. The method as recited in claim 1, wherein the tie is passed through an aperture in both plates of the pair of plates.

6. The method as recited in claim 1, wherein the aperture is a slot extending to an edge of the plate.

* * * * *